US007581685B2

(12) United States Patent
Belisle

(10) Patent No.: US 7,581,685 B2
(45) Date of Patent: Sep. 1, 2009

(54) FAUCET END PIECE

(76) Inventor: Christian Belisle, 13581 rue Armand, Mirabel, QC (CA) J7J 1B8

( * ) Notice: Subject to any disclaimer, the term of this patent is extended or adjusted under 35 U.S.C. 154(b) by 231 days.

(21) Appl. No.: 11/780,341

(22) Filed: Jul. 19, 2007

(65) Prior Publication Data

US 2009/0020628 A1 Jan. 22, 2009

(51) Int. Cl.
*E03C 1/08* (2006.01)
*A62C 31/00* (2006.01)

(52) U.S. Cl. ..... 239/428.5; 239/443; 239/445; 239/447

(58) Field of Classification Search ..... 239/443–449, 239/428.5, 569–570, 575, 435, 390–392, 239/396

See application file for complete search history.

(56) References Cited

U.S. PATENT DOCUMENTS

| | | | | | |
|---|---|---|---|---|---|
| 2,592,953 | A | | 4/1952 | Roberts | |
| 3,334,818 | A | * | 8/1967 | Moen | 239/428.5 |
| 3,524,591 | A | * | 8/1970 | Samuels et al. | 239/428.5 |
| 3,943,967 | A | | 3/1976 | Holt et al. | |
| 4,345,719 | A | | 8/1982 | Bock | |
| 4,733,819 | A | | 3/1988 | Aghnides | |
| 4,903,725 | A | | 2/1990 | Ko et al. | |
| 5,071,071 | A | * | 12/1991 | Chao | 239/428.5 |
| 5,107,884 | A | | 4/1992 | Orlandi et al. | |
| 5,154,355 | A | * | 10/1992 | Gonzalez | 239/428.5 |
| 5,348,231 | A | * | 9/1994 | Arnold et al. | 239/428.5 |
| 5,494,222 | A | | 2/1996 | Chiu et al. | |
| 6,073,647 | A | | 6/2000 | Cook et al. | |
| 6,994,277 | B1 | | 2/2006 | Barnes | |
| 7,017,837 | B2 | * | 3/2006 | Taketomi et al. | 239/428.5 |
| 7,431,224 | B2 | * | 10/2008 | Laker | 239/533.1 |
| 2003/0141480 | A1 | | 7/2003 | Green | |
| 2004/0124267 | A1 | * | 7/2004 | Ouyoung | 239/394 |

FOREIGN PATENT DOCUMENTS

| | | |
|---|---|---|
| JP | 2003148111 | 5/2003 |

* cited by examiner

*Primary Examiner*—Len Tran
*Assistant Examiner*—Justin Jonaitis
(74) *Attorney, Agent, or Firm*—Darby & Darby P.C.

(57) ABSTRACT

A faucet end piece connectable to a faucet nozzle is provided including a cylindrical body defining a cavity, a vertical pipe extending within the cavity, and an internal partition with water passages therethrough, extending across the cavity and connecting the vertical pipe to the body; a valve insertable in the cavity including a cap portion fitting over the vertical pipe and having at least one side orifice, a bore and a flange portion projecting transversally from the cap portion; a resilient element insertable inside the cavity between the body's internal partition and the valve flange portion. The valve is movable vertically under water pressure between an upper position wherein water flows through the cap portion side orifice, the bore and through the body vertical pipe, and a lower position where water flows around the cap portion through the internal partition water passages.

15 Claims, 4 Drawing Sheets

FAUCET END PIECE

FIELD OF THE INVENTION

The present invention relates to the field of plumbing accessories and more particularly concerns a faucet end piece which is connectable to a faucet such as a kitchen or bathroom faucet.

BACKGROUND OF THE INVENTION

Regular faucet nozzles are usually provided with faucet head screen which diffuses the water exiting the faucet nozzle, regulating the outputted water velocity. This diffusing however limits the outputted water pressure which as a result can be inefficient for certain activities, such as for example rinsing a razor blade or the like.

Alternative to faucet head screen are faucet aerators which are commonly used to reduce home water consumption. Faucet aerators replace the faucet head screen, lowering the flow by adding air to the spray. The air-water mixture under pressure creates a high velocity spray, which makes it seem like more water is coming out than there actually is.

U.S. Pat. No. 5,071,071 describes an aerator structure connectable to a faucet nozzle useful to minimize the water stream variation depending on specific water stream and pressure. This aerator comprises a main body and the following parts insertable in this body: a vertical cylinder, a mixing member, a partition member, a spring and a valve. A bevel contact surface and a water passage are provided between the valve and the partition member. When the water pressure varies, the valve moves up or down at a given high in the body by means of the spring so as to maintain the water stream at a given volume. When the aerator is installed on a faucet supplying water at a lowest standard water pressure (i.e. 20 PSI), that pressure is insufficient to move the valve downwardly, the valve remains in its highest position and the water flows through the slots on the top portion of the valve into a first water passage formed between the first cylinder and the bevel surface of the partition member. Then, the water flows into a second water passage formed with the cylindrical body and the lowest portion of the valve, and recesses and the second cylinder of the partition member. At the end, the water flows into the water passage of the mixing member. When the water pressure varies and eventually reaches its maximum, the bevel contact surface of the valve is in contact with the bevel surface of the partition member and the water flows through the slots in a less volume as a result of the bevel contact surface being closed. When the water pressure is reduced again to the lowest standard, the bevel contact surface is not in contact with the first cylinder, and then a maximum volume of water flows through the first water passage. Accordingly, this aerator allows keeping the volume of water constant when the pressure varies.

U.S. Pat. No. 5,348,231 describes a two-stage aerator connectable to a faucet nozzle. This aerator is a manually actuable faucet aerator providing two different flows. It includes a fixed stem assembly and a body assembly manually moveable with respect thereto. In a first position, which is the position where the aerator returns when the water flow is topped, the aerator provides water in low-volume. The aerator is also actuable to a second, high-volume position, to permit increased flow as necessary. Thus, the user needs to grasp the body portion of the aerator and pull it down to switch the aerator to the high-volume stream position. This system is independent of the water velocity at the aerator inlet and requires manual action to change position from low flow to higher flow.

Thus, there is still a need for a simple and easy to install faucet end piece providing an increase water velocity at the outlet of the faucet independently of the inlet water pressure, while still allowing water conservation.

OBJECT AND SUMMARY OF THE INVENTION

It is an object of the present invention to provide a faucet end piece connectable to a faucet nozzle providing different water streams at the outlet thereof. The faucet end piece of the invention also allows getting more pressure at the outlet thereof while using less water.

Accordingly, the present invention provides a faucet end piece connectable to an extremity of a faucet nozzle, wherein the faucet supplies water at a controllable water pressure. The faucet end piece includes a cylindrical body having upper and lower portions, wherein the upper portion is connectable to the faucet nozzle. The cylindrical body includes a cylindrical side wall defining a cavity therein, a hollow vertical pipe extending within the cavity, and an internal partition extending across the cavity and connecting the hollow vertical pipe to the cylindrical side wall, the internal partition being provided with at least one water passage therethrough. The faucet end piece also includes a valve insertable in the cavity and including a cap portion having a closed upper end, a bore therethrough and an opened lower end. The cap portion is adapted to fit over the hollow vertical pipe of the cylindrical body and has at least one side orifice therein. The valve is also provided with a flange portion projecting transversally from the cap portion. The faucet end piece further includes a resilient element insertable within the cavity of the cylindrical body between the internal partition of the cylindrical body and the flange portion of the valve for biasing the valve upwardly. The valve is movable vertically within the cavity under the effect of the water pressure between an upper position range wherein water is allowed to flow down through the at least one side orifice of the cap portion of the valve, the bore of the cap portion of the valve and through the hollow vertical pipe of the cylindrical body, and a lower position range where water is allowed to flow around the cap portion of the valve and through the at least one water passage in the internal partition of the cylindrical body.

Other features and advantages of the present invention will be better understood upon reading of a preferred embodiment thereof with reference to the appended drawings.

DESCRIPTION OF PREFERRED EMBODIMENTS OF THE INVENTION

Figure 1:
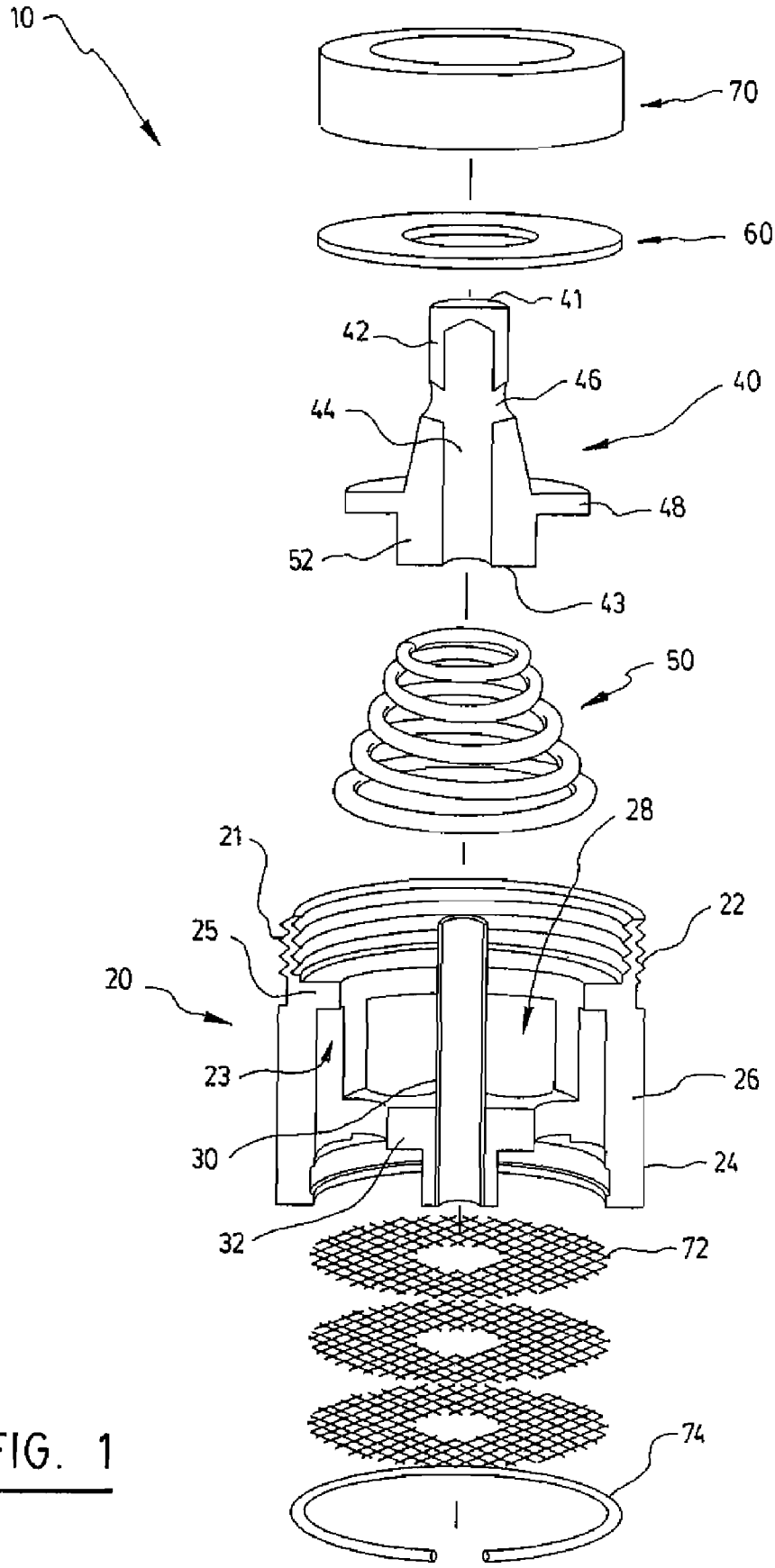
FIG. 1 is an exploded view of a faucet end piece according to a preferred embodiment of the invention.
Figure 2:
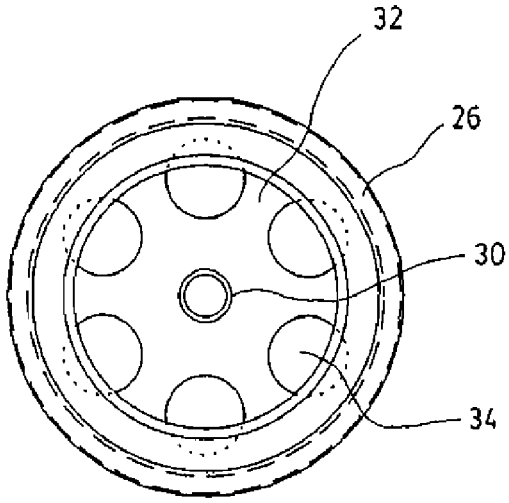
FIG. 2 is a top view of the cylindrical body in partial transparency of the faucet end piece shown in FIG. 1.
Figure 3:
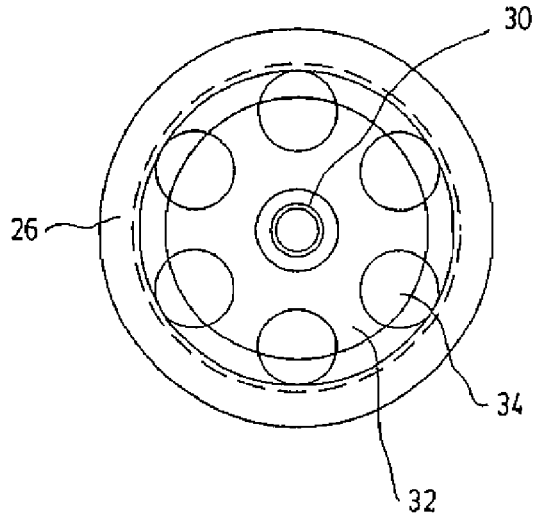
FIG. 3 is a bottom view of the cylindrical body of the faucet end piece shown in FIG. 1.
Figure 4:
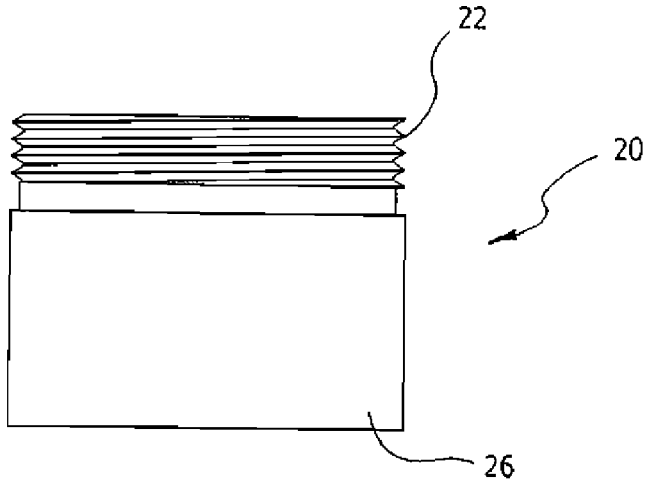
FIG. 4 is side view of the cylindrical body of the faucet end piece shown in FIG. 1.

In accordance with a preferred embodiment of the invention, there is provided a faucet end piece which is connectable to the nozzle of a faucet such as a kitchen or bathroom faucet, which allows better managing the water volume and velocity at the outlet of the faucet.

An advantage of this faucet end piece is that it allows to get higher water velocity with a low volume of water from the outlet of the nozzle when the tap is slightly opened, while limiting the water pressure at the faucet outlet when the tap is fully opened or higher volume of water is needed as for a standard head screen.

Accordingly, this faucet end piece is useful to provide a greater water velocity at the outlet of the faucet while using less water.

Accordingly, this faucet end piece is very useful in places where the water supply and distribution does not allow for sufficient pressure at the taps for common household tasks or to get washed. For example, the faucet end piece according to the invention could be helpful for rinsing a razor blade or the like.

However, the use of the faucet end piece of the invention is not limited to places where the water pressure supply is inefficient and may be used with any faucet for saving water.

Referring to FIGS. 1 to 4, there is shown a faucet end piece according to a preferred embodiment of the invention. The faucet end piece (10) has a cylindrical body (20) having an upper portion (22), a lower portion (24), and a cylindrical side wall (26) defining a cavity therein (28). Preferably, the outer surface of the upper portion of the body (22) includes screw threads (21) in order to connect the faucet end piece to the faucet nozzle. It is understood that these screw threads may be either male or female screw threads so that the faucet end piece may be connected to faucets having either male or female screw threads. In another embodiment, the upper portion of the body is shaped to include both male and female screw threads, with male threads either on the external or the internal surface of the upper portion of the body and female threads on the other surface. The cylindrical body (20) also includes a hollow vertical pipe (30) which extends within the cavity (28) and is preferably concentric to the cylindrical body (20). It is understood that the adjective "vertical" is used herein to indicate that the hollow pipe extends along a direction generally longitudinal within the cylindrical body, which in use will be along a somewhat vertical axis, but that it is not understood to be limited to a strict verticality. An internal partition (32) extending across the cavity (28) and connects the hollow vertical pipe (30) to the cylindrical side wall (26). The internal partition (32) is provided with at least one water passage (34) therethrough. Preferably, the internal partition (32) is provided with a plurality of water passages to better direct the water flow throughout the faucet end piece. The internal partition is preferably disposed within the lower portion of the cylindrical body a little above the lower end thereof. The cylindrical body, hollow vertical pipe and internal partition are preferably integral to each other and may be manufactured as a single piece.

In an embodiment of the invention, the cylindrical side wall (26) includes at least one recess (23) in its internal portion defining an abutment (25), the recess opening on the at least one water passages (34) of the internal partition. Preferably, the cylindrical side wall includes a number of recesses identical to the number of water passages in the internal partition member to which they are connected.

Preferably, the body of the faucet end piece is made of a corrosive resistant material or a mixture of corrosive resistant materials. Advantageously, the body is made of brass metal or plastic or a mixture of brass metal and plastic. For example, the cylindrical side walls of the body may be made of brass and the hollow vertical pipe of plastic or vice versa.

The faucet end piece (10) also includes a valve (40) insertable within the cavity of the cylindrical body (28). The valve (40) includes a cap portion (42) closed at its upper end (41) and opened at its lower end (43) and being provided with a bore (44) going through the valve. The cap portion is adapted to fit over the hollow vertical pipe (30) of the cylindrical body and is provided with at least one side orifice (46). Preferably, the valve is provided with two opposite side orifices to better direct the water flow inside the hollow vertical pipe (30). Finally, the valve further includes a flange portion (48) projecting transversally from the cap portion (42). Advantageously, the valve is made of a corrosive resistant material or a mixture of corrosive resistant materials. Advantageously, the valve is made of brass metal or plastic or a mixture thereof.

Figure 5A:
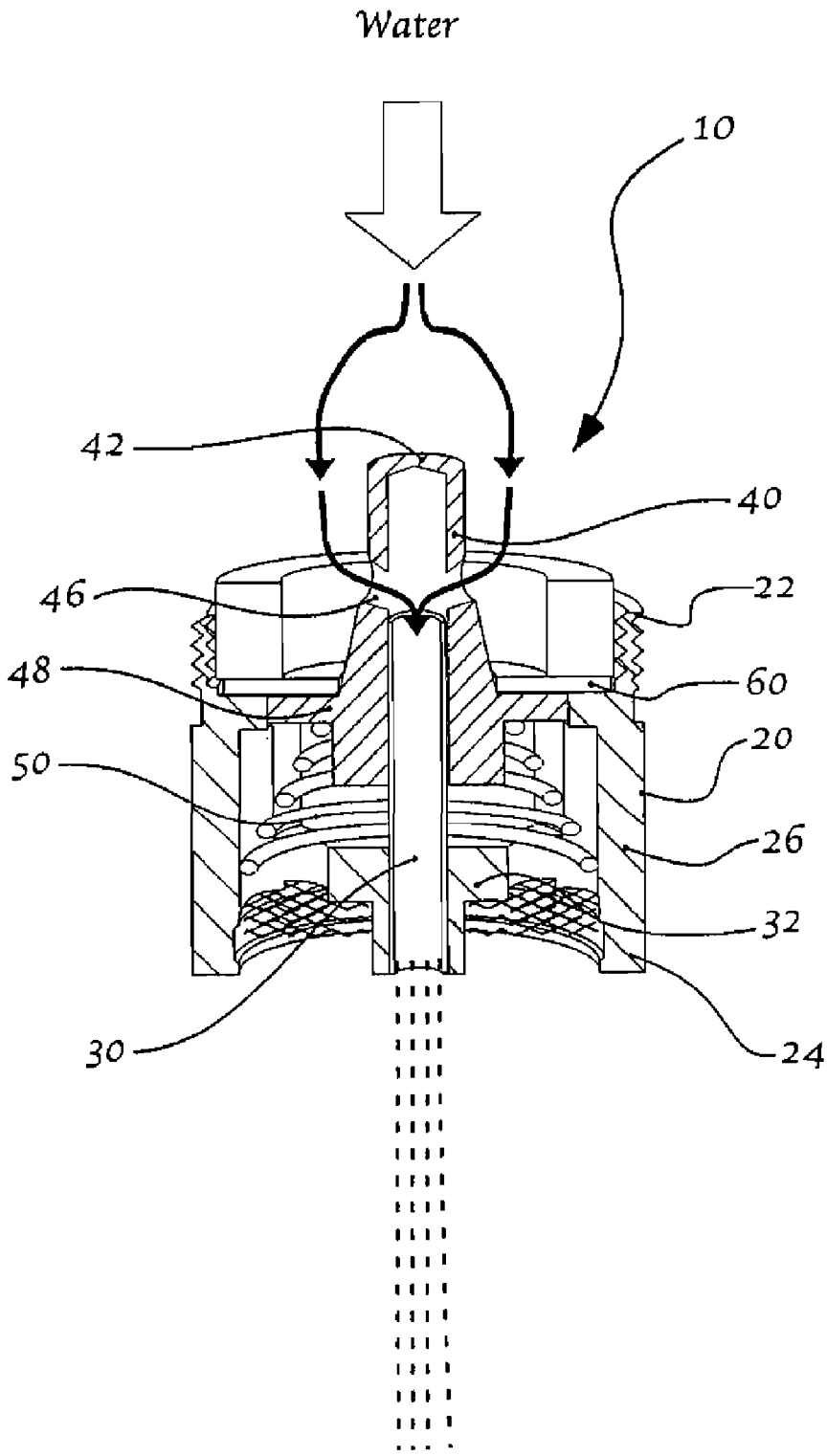
FIGS. 5*a* and 5*b* are cross-sectional views of the faucet end piece of the faucet end piece shown in FIG. 1 when in use, with the valve respectively in the upper and lower positions.
Figure 5B:
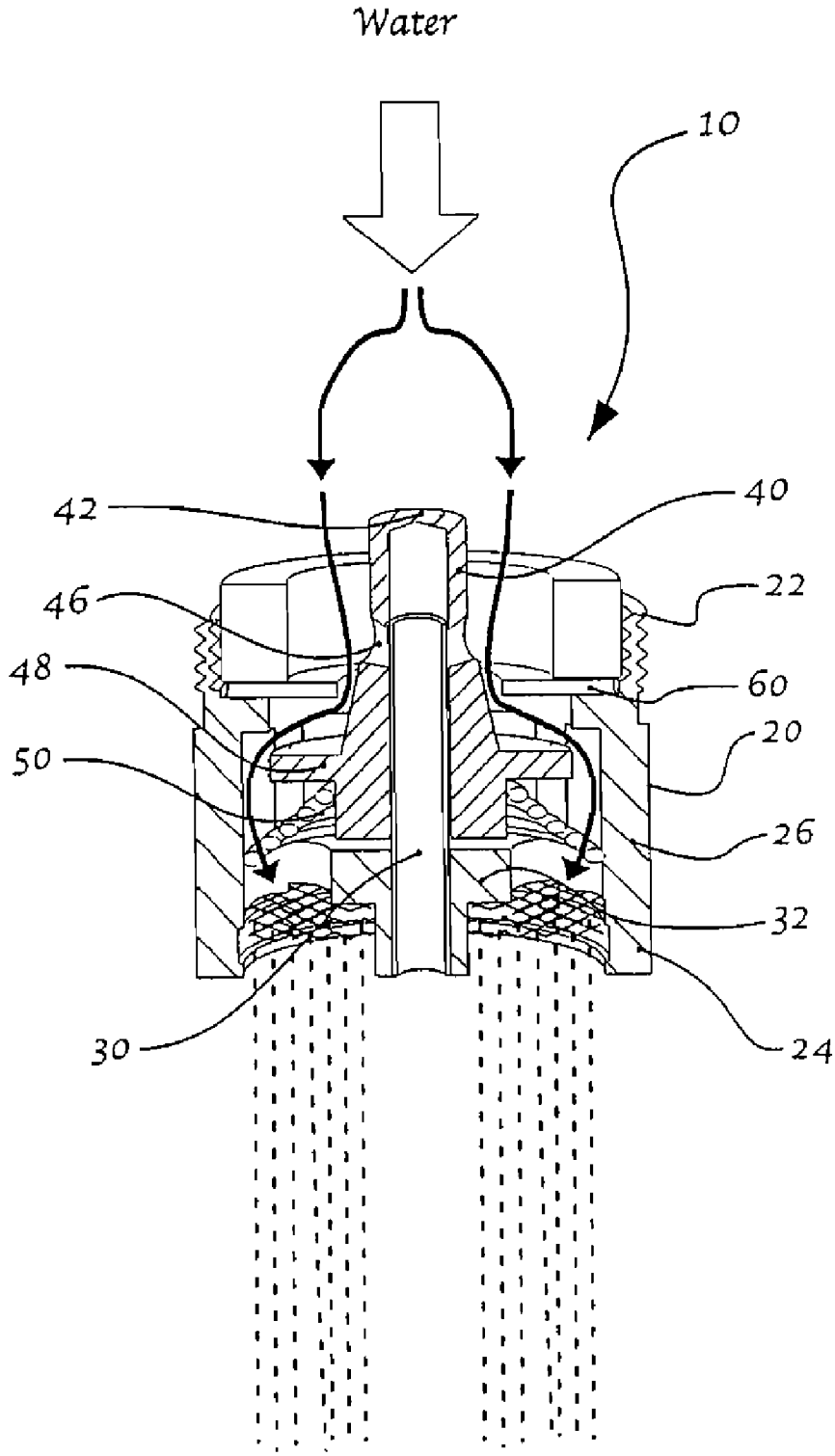

As shown in FIGS. 1, 5*a* and 5*b*, the faucet end piece also includes a resilient element (50) insertable inside the cavity (28) between the internal partition of the cylindrical body (32) and the flange portion of the valve (48) for biasing the valve upwardly. The resilient element (50) is preferably a spring. Even more preferably, the spring has a conical shape with its large end abutting against the internal partition (32). Advantageously, the narrow end of the spring is sized to receive the lower end of the valve (40) which is preferably shaped as a post (52). The spring is preferably made of a stainless steel alloy, such as for example a stainless steel comprising a nickel-chrome alloy.

As shown in FIGS. 5*a* and 5*b*, the valve (40) is movable vertically within the cavity (28) under the effect of the water pressure between an upper position range wherein water is allowed to flow down through the at least one side orifice (46) of the cap portion (42) of the valve, the bore (46) of the cap portion of the valve and through the hollow vertical pipe (30) of the cylindrical body, and a lower position range where water is allowed to flow around the cap portion (42) of the valve and through the at least one water passage (34) in the internal partition (32) of the cylindrical body. This movement and its effect will be explained in more detail further below.

As shown in FIG. 1, the faucet end piece according to the preferred embodiment of the invention preferably includes an annular valve joint (60) insertable in the cavity of the cylindrical body (28). This annular valve joint is adapted to fit around the cap portion of the valve (42) and is sized to abut against the abutment (25) of the cylindrical side wall of the body. Preferably, the annular valve joint consists of a ring, such as a Teflon® ring.

The faucet end piece advantageously also includes a sealing device (70) insertable in the cavity of the cylindrical body (28) above the valve joint (60) to waterproof the connection of the faucet nozzle to faucet end piece. The sealing device (70) may be a standard sealing device such as a rubber or neoprene ring.

Preferably, the faucet end piece according to the preferred embodiment of the invention also comprises at least one faucet screen (72) attachable to the bottom of the cylindrical body (20). In the preferred embodiment three such screens are provided, but one skilled in the art will readily understand that any appropriate number of faucet screens may be considered within the scope of the present invention. The screens are preferably annular in shape and include a central hole in alignment with the hollow vertical pipe (30) of the body (20). In this manner the screens will diffuse water exiting the water passages in the inner partition of the cylindrical body, but not water exiting the hollow vertical pipe. These screens may advantageously be maintained in position by means of a retaining ring which interlocks the screens inside the body.

In use, if the tap controlling the water outflow going through the faucet is slightly opened (see FIG. 5*a*), the water running out of the nozzle arrives at the top of the faucet end piece (10) with a low outflow. This outflow will be insufficient to push down the valve, which will remain biased upward by the spring. The water will therefore flow into the two side orifices (46) of the valve cap portion (42), run through the bore (44) and into the hollow vertical pipe (30) of the cylindrical body where the velocity eventually increases due to the small diameter of the pipe. The water therefore gets out of the faucet end piece at the bottom of the hollow vertical pipe (30) with a higher velocity than it was at the outlet of the nozzle.

If the tap is fully opened or opened up to a certain degree (see FIG. 5*b*), the water arrives at the top of the faucet end piece (10) with a greater outflow. Then, the water exerts pressure on the cap portion of the valve (42) and the pressure is transferred to the resilient element (50) which contracts. When the resilient element (50) contracts, the top extremity of the bore (44) rests against the top of the hollow vertical pipe of the body (30) and the two side orifices (46) get blocked. The water runs in the direction of the recesses in the cylindrical side wall (26) and through the water passages (34) of the internal partition (32). If the faucet end piece is provided with the valve joint (60) which abuts to the abutment (25) of the body, then the water runs in the direction of this valve joint, flows off by an opening formed between the cap portion of the valve (42) and the internal part of the valve joint in the direction of the water passages (34). If the faucet end piece includes a screen, then the water runs through this screen and the water velocity at the outlet of the faucet end piece is decreased as for a standard faucet screen.

A faucet end piece as described in details hereinabove has been connected to a standard faucet and measurements have been carried out to assess the quantity of water saved and the pressure increase at the outlet of the faucet end piece. These measurements have shown that using the faucet end piece allowed using about 7 times less water while obtaining a pressure about 23 times higher compared to the standard faucet without the faucet end piece.

A great advantage of the faucet end piece (10) of the present invention is that the shift from a water flow at high velocity to a normal water flow at the outlet of the faucet end piece, is simply controlled by the user directly at the tap. The faucet end piece does not need another element to achieve that control.

Of course, numerous modifications could be made to the above-described embodiments without departing from the scope of the invention, as apparent to a person skilled in the art. While a specific embodiment of the present invention has been described and illustrated, it will be apparent to those skilled in the art that numerous modifications and variations can be made without departing from the scope of the invention as defined in the appended claims.

The invention claimed is:

1. A faucet end piece connectable to an extremity of a faucet nozzle, said faucet supplying water at a controllable water pressure, said faucet end piece comprising:

a cylindrical body having upper and lower portions, said upper portion being connectable to the faucet nozzle, said cylindrical body comprising:

a cylindrical side wall defining a cavity therein;

a hollow vertical pipe extending within the cavity; and an internal partition extending across said cavity and connecting the hollow vertical pipe to the cylindrical side wall, said internal partition being provided with at least one water passage therethrough;

a valve insertable in said cavity and comprising:

a cap portion having a closed upper end, a bore therethrough and an opened lower end, said cap portion being adapted to fit over the hollow vertical pipe of said cylindrical body and having at least one side orifice therein; and a flange portion projecting transversally from said cap portion; and a resilient element insertable within said cavity between the internal partition of the cylindrical body and the flange portion of the valve for biasing said valve upwardly;

wherein said valve is movable vertically within the cavity under the effect of said water pressure, between an upper position range wherein water is allowed to flow down through the at least one side orifice of the cap portion of the valve, the bore of the cap portion of the valve and through the hollow vertical pipe of the cylindrical body, and a lower position range where water is allowed to flow around the cap portion of the valve and through the at least one water passage in the internal partition of the cylindrical body.

2. The faucet end piece according to claim 1, further comprising at least one recess in an internal portion of the cylindrical side wall, said at least one recess defining an abutment and opening on the at least one water passage of the internal partition.

3. The faucet end piece according to claim 2, further comprising an annular valve joint insertable in the cavity of the cylindrical body and sized to abut against the abutment of the cylindrical side wall.

4. The faucet end piece according to claim 3, further comprising a sealing device insertable in the cavity of the cylindrical body above the valve joint.

5. The faucet end piece according to claim 1, further comprising at least one faucet screen connectable to the lower portion of the body for diffusing water flowing from the at least one passage in the internal partition of the cylindrical body.

6. The faucet end piece according to claim 5, wherein said at least one faucet screen has an annular shape defining a central hole, said central hole being aligned with the hollow vertical pipe.

7. The faucet end piece according to claim 1, wherein the resilient element is a spring.

8. The faucet end piece according to claim 7, wherein the spring is made of a stainless steel alloy.

9. The faucet end piece according to claim 1, wherein the cap portion of the valve comprises two of said at least one side orifice disposed opposite to each other.

10. The faucet end piece according to claim 1, wherein the upper portion of the cylindrical body has a threaded outer surface for connecting to the faucet nozzle.

11. The faucet end piece according to claim 1, wherein said cylindrical body and said valve are made of a corrosive resistant material or a mixture of corrosive resistant materials.

12. The faucet end piece according to claim 11, wherein said body and said valve are made, independently one to another, of brass metal or plastic or a mixture of brass metal and plastic.

13. The faucet end piece according to claim 3, wherein said annular valve joint is a Teflon® ring.

14. The faucet end piece according to claim 4, wherein said sealing device is a rubber or neoprene ring.

15. The faucet end piece according to claim 1, wherein said at least one water passage comprises a plurality of said water passages disposed in a circular arrangement within said cylindrical body.

* * * * *